US006619768B1

(12) United States Patent
Northrop et al.

(10) Patent No.: US 6,619,768 B1
(45) Date of Patent: Sep. 16, 2003

(54) PORTABLE STORAGE CONTAINER

(75) Inventors: Melaney Northrop, Cleburne, TX (US); Scott A. Skurdalsvold, Arlington, TX (US)

(73) Assignee: Doskocil Manufacturing Company, Inc., Arlington, TX (US)

( * ) Notice: Subject to any disclaimer, the term of this patent is extended or adjusted under 35 U.S.C. 154(b) by 0 days.

(21) Appl. No.: 10/084,422

(22) Filed: Feb. 28, 2002

(51) Int. Cl.[7] ..... A47B 81/00
(52) U.S. Cl. ..... 312/290; 312/321.5
(58) Field of Search ..... 312/283, 290, 312/321.5, 229, 228, 280, 236; 206/570, 372, 486, 803

(56) References Cited

U.S. PATENT DOCUMENTS

| | | | | |
|---|---|---|---|---|
| 251,337 | A | * 12/1881 | Burrows | 312/232 |
| 1,082,082 | A | 12/1913 | Jiranek | |
| 1,793,183 | A | 3/1931 | Voshardt | |
| 2,357,555 | A | * 9/1944 | Seaton | 312/209 |
| 2,480,876 | A | 9/1949 | Paden | |
| 2,505,898 | A | 5/1950 | Jaffe et al. | |
| 2,669,641 | A | 2/1954 | Becker | |
| 3,070,416 | A | * 12/1962 | Post | 312/241 |
| 3,082,050 | A | 3/1963 | Baxter et al. | |
| D202,160 | S | 8/1965 | Territo | |
| 3,251,637 | A | 5/1966 | Parsons, Jr. | |
| 3,481,066 | A | 12/1969 | Woolworth | |
| 3,543,890 | A | 12/1970 | Criswell | |
| 3,860,307 | A | 1/1975 | Fostel | |
| 3,915,529 | A | 10/1975 | Bernier | |
| 4,023,304 | A | * 5/1977 | Singer | 43/54.1 |
| D252,960 | S | 9/1979 | Faust | |
| 4,344,660 | A | * 8/1982 | Molnar et al. | 312/249.13 |
| D272,705 | S | 2/1984 | Gottsegen et al. | |
| 4,747,169 | A | 5/1988 | Valbuena | |
| 4,858,840 | A | * 8/1989 | Kidman | 242/596.3 |
| 5,007,569 | A | 4/1991 | Zarb | |
| 5,110,193 | A | 5/1992 | McClenning | |
| 5,156,450 | A | 10/1992 | Lee | |
| 5,202,098 | A | 4/1993 | Nichols | |
| 5,269,599 | A | * 12/1993 | Moring | 312/290 |
| 5,281,016 | A | 1/1994 | Brague | |
| 5,349,708 | A | 9/1994 | Lee | |
| 5,664,853 | A | 9/1997 | Nickolaus, Jr. | |
| 5,676,240 | A | 10/1997 | Cziraky et al. | |
| 5,683,157 | A | 11/1997 | Peterson et al. | |
| 5,758,933 | A | 6/1998 | Clendening | |
| 5,806,944 | A | 9/1998 | Greenfield | |
| 5,975,658 | A | * 11/1999 | Verbeek et al. | 312/209 |
| 5,979,725 | A | 11/1999 | Lehrman | |
| 6,079,400 | A | 6/2000 | Tomat Dany | |
| 6,099,096 | A | * 8/2000 | Lambright | 312/321.5 |
| D440,429 | S | * 4/2001 | Wales et al. | D6/446 |
| D443,137 | S | 6/2001 | Lai | |

FOREIGN PATENT DOCUMENTS

| | | | |
|---|---|---|---|
| AT | 162407 | * 7/1948 | 312/290 |
| WO | WO 01/44015 A1 | 6/2001 | |

OTHER PUBLICATIONS

BeaverTree Camp' Kitchen: Beryln Enterprises LLC; www-.berynenterpri . . . om/ecommerce/beavertree_searchpage.shtml; last update 2003.*

Cabela's, Internet Advertisement, Dec. 12, 2001, Chuck Box Super Deluxe Chuck Box.

* cited by examiner

*Primary Examiner*—Janet M. Wilkens
(74) *Attorney, Agent, or Firm*—Locke Liddell & Sapp LLP

(57) ABSTRACT

A portable storage container includes a main storage compartment and first and second doors each including a door storage compartment. The doors are pivotally mounted to the main storage compartment and are adapted to move between a closed position and an open position. In the open position, the doors allows access to the open front of the main storage compartment. In the closed position, the doors completely close the open front of the main storage compartment.

33 Claims, 6 Drawing Sheets

PORTABLE STORAGE CONTAINER

TECHNICAL FIELD OF THE INVENTION

The present invention relates to a portable storage container, and more particularly to a portable camp kitchen.

BACKGROUND OF THE INVENTION

When camping, both backpacking and car camping, or otherwise traveling away from home, it is desirable to pack food and equipment for preparing meals. The ease or freedom of camping or travel can be defeated when the camper is required to carry along a variety of utensils and food products. Often the camper brings along a stove, plates, cups, knives, forks, utensils, and a variety of foods and containers. Typically these items are carried separately or grouped together in a variety of bags, containers, or boxes. A variety of food items combined with other equipment can become numerous and burdensome for transport and organization. Accordingly, a need exists for a self-contained carrier or transport for such items.

In addition to centralizing all food related items, it is desirable to minimize the amount of equipment needed for camping. Equipment that accomplishes multiple purposes eliminates the need for carrying surplus supplies. One such supply is to have a sink or washbasin. A sink can be used to wash dishes or clothes or to carry water or a variety of other items. A need has thus arisen for a container which includes a sink and requires little or no additional space.

An additional need for campers is the use of a sturdy workspace. In the absence of a picnic table, a camper often seeks to find an alternative. A support structure which allows the camper to conveniently operate a stove, or otherwise prepare a meal is very desirable. Rather than placing items on the ground, campers seek convenient surfaces or tables. Such surfaces or tables must provide easy access to a stove during use.

A need has thus arisen for a portable storage container for use as a camp kitchen which can store and transport a variety of equipment for meal preparation, including such equipment as a sink and a work surface combined in a container which is compact and easy to carry.

SUMMARY OF THE INVENTION

In accordance with the present invention, a portable storage container is provided. The container includes a main storage compartment and first and second doors each including a door storage compartment. The first door is pivotally mounted to a first side panel of the main storage compartment and is adapted to move between a closed position and an open position. In the open position, the first door is disposed parallel to the first side panel of the main storage compartment to allow access to the open front of the main storage compartment. In the closed position, the first door partially closes the open front of the main storage compartment. The second door is pivotally mounted to a second side panel of the main storage compartment and is adapted to move between a closed position and an open position. In the open position, the second door is disposed parallel to the second side panel of the main storage compartment to allow access to the open front of the main storage compartment. In the closed position, the second door partially closes the open front of the main storage compartment. The first and second doors completely close the open front of the main storage compartment when the doors are closed.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
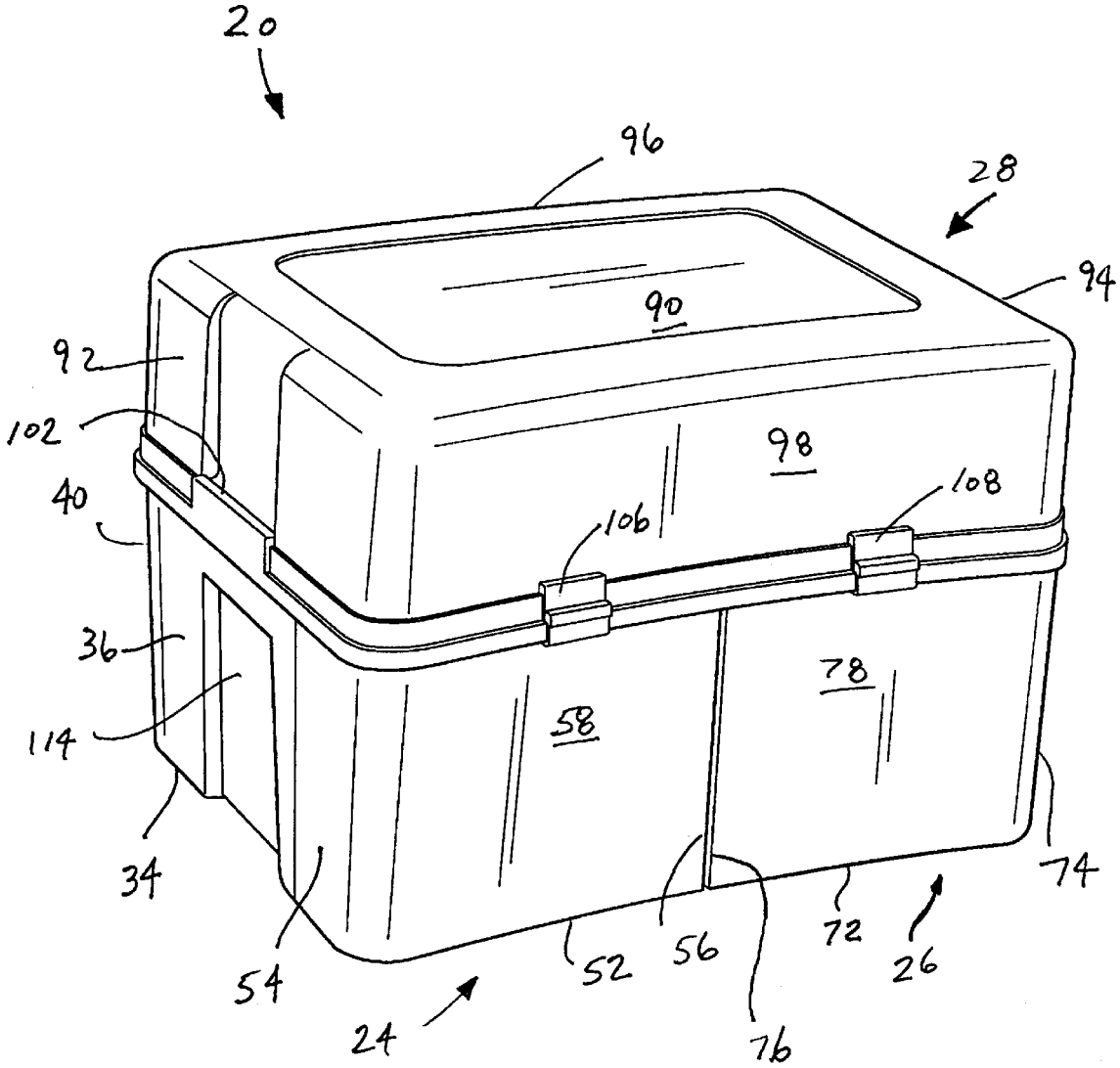
FIG. 1 is a perspective view of the present portable storage container.
Figure 2:
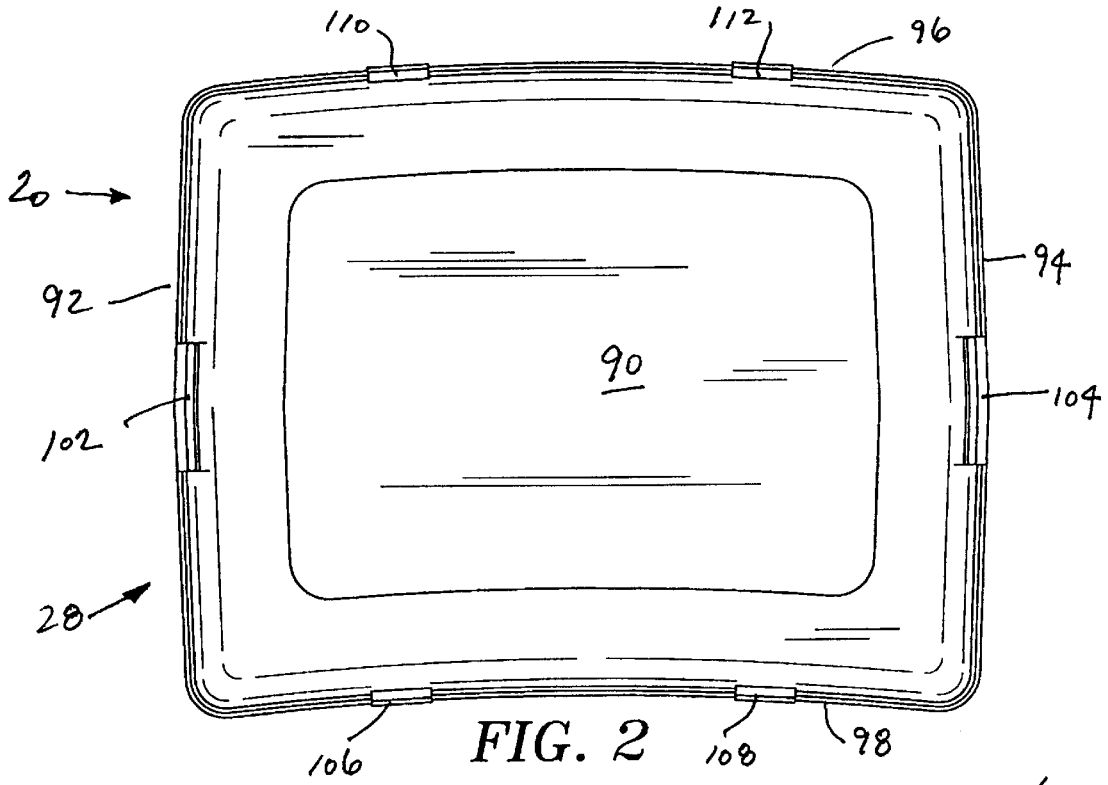
FIG. 2 is a top plan view thereof.

Referring simultaneously to FIGS. 1–4, the present portable storage container is illustrated, and is generally identified by the numeral 20. Portable storage container 20 includes a main storage compartment, generally identified by numeral 22, a first door, generally identified by numeral 24, a second door, generally identified by the numeral 26, and a lid, generally identified by the numeral 28.

Main storage compartment 22 includes a top panel 32 (FIG. 4), a base panel 34, a first side panel 36, a second side panel 38, and a back panel 40. Top panel 32, base panel 34, sides 36 and 38, and back panel 40 form main storage container 22 which has an open front 42.

Figure 4:
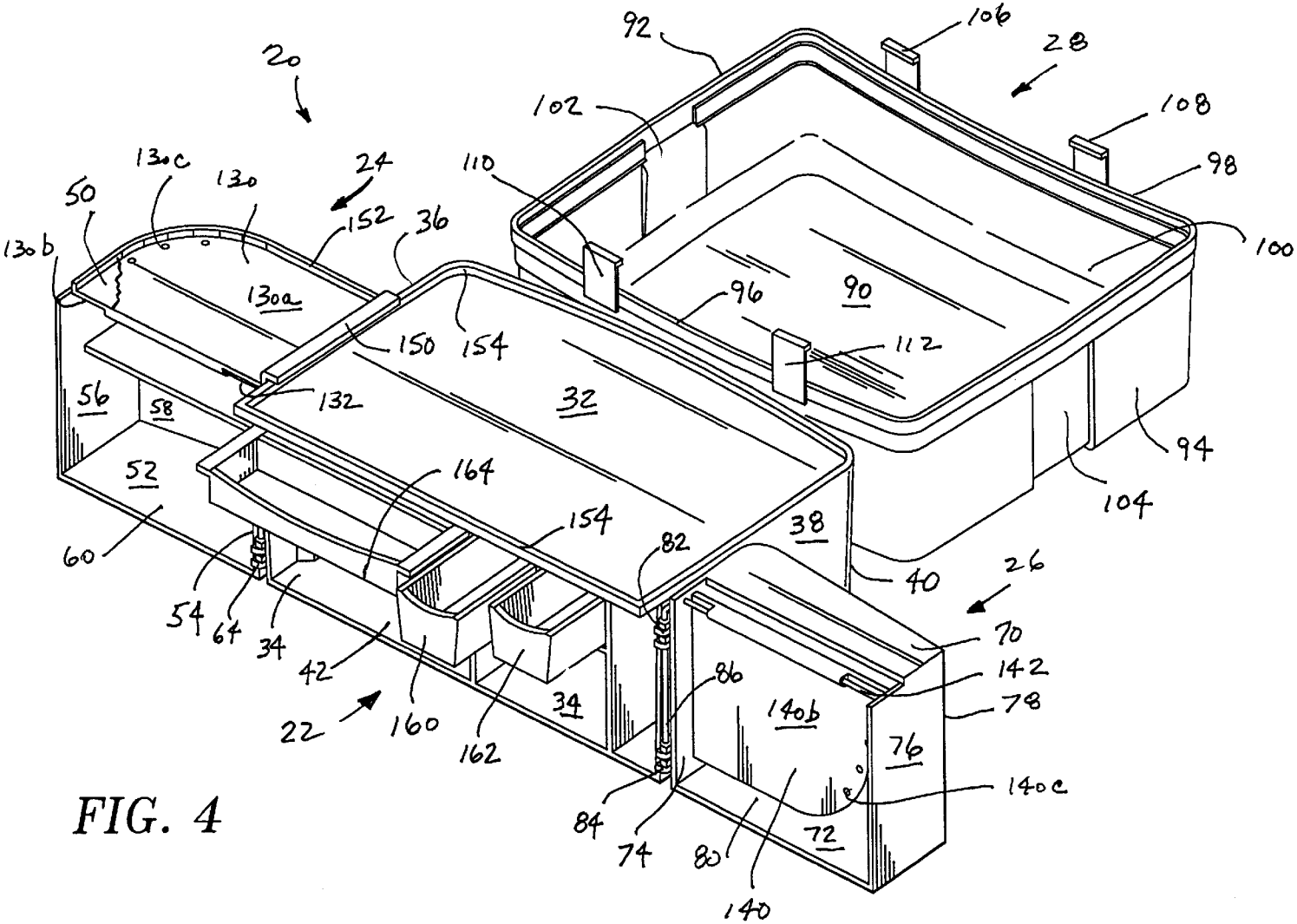
FIG. 4 is a perspective view of the present portable storage container in the open position with the doors open and lid removed.

First door 24 is pivotally mounted to first side panel 36 of main storage compartment 22 and is adapted to move between a closed position as illustrated in FIG. 1, and an open position as illustrated in FIG. 4. First door 24 includes a top panel 50, a base panel 52, a first side panel 54, a second side panel 56, a back panel 58 and an open front 60.

In the open position of first door 24, first side panel 54 is disposed parallel to first side panel 36 of main storage compartment 22 to allow partial access to open front 42 of main storage compartment 22 in the closed position of door 24, door 24 partially closes open front 42 of main storage compartment 22. First door 24 is hingedly attached to first side panel 36 of main storage compartment 22 using hinges 62 and 64 which are connected with a rod 66.

Second door 26 includes a top panel 70 (FIG. 4), a base panel 72, a first side panel 74, a second side panel 76, and a back panel 78. Second door 26 has an open front 80 (FIG. 4). In the open position of second door 26, first side panel 74 is disposed parallel to second side panel 38 of main storage compartment 22 to allow access to open front 42 of main storage compartment 22. In the closed position of door 26, door 26 partially closes open front 42 of main storage compartment 22. Second door 26 is hingedly attached to second side panel 38 of main storage compartment 22 using hinges 82 and 84 which are connected with a rod 86.

As illustrated in FIG. 1, when doors 24 and 26 are closed, open front 42 of main storage compartment 22 is completely closed. When doors 24 and 26 are open, the user has easy access to main storage compartment 22 and to top panel 32 for cooking and food preparation. Doors 24 and 26 by extending outwardly from the sides of main storage compartment 22 do not obstruct the user in gaining access to a stove that may be positioned on top panel 32.

Lid 28 includes a top panel 90, a first side panel 92, a second side panel 94, a back panel 96, and a front panel 98. Lid 28 has an open bottom 100 which is accessible when lid 28 is removed from storage container 20. Lid 28 includes handles 102 and 104 for grasping lid 28 when removed from storage container 20.

Front panel 98 of lid 28 includes fasteners 106 and 108 for fastening lid 28 to doors 24 and 26, respectively, in the closed position. Back panel 96 of lid 28 includes fasteners 110 and 112 for fastening lid 28 to back panel 40 of main storage compartment 22.

Figure 3:
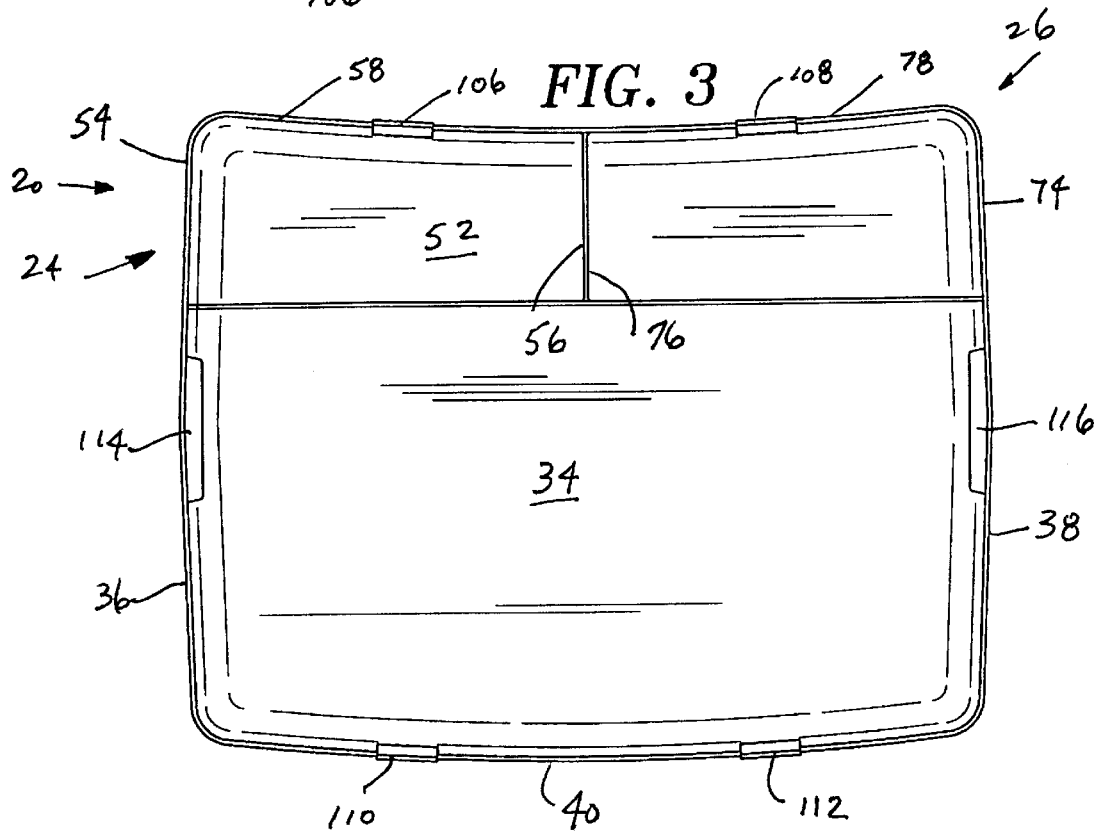
FIG. 3 is a bottom plan view thereof.

First side panel 36 of main storage compartment 22 includes a handle 114. Second side panel 38 of main storage compartment 22 includes a handle 116 (FIG. 3) An important aspect of the present invention is the configuration of back panel 58 of door 24 and back panel 78 of door 26 which is best illustrated in FIG. 3. This configuration forms a generally concave surface of back panels 58 and 78 which allows a user to carry storage container 20 by utilizing handles 114 and 116 close to the user's body. By carrying storage container 20 close to the user's body, greater stability is achieved when the user transports storage container 20.

Referring now to FIG. 4, door 24 includes a cover 130 having an inner surface 130*a* and an outer surface 130*b*. Cover 130 is pivotally mounted onto a rod 132 which extends between side panels 54 and 56 of door 24. Door 26 includes a cover 140 having an inner surface 140*a* and an outer surface 140*b*. Cover 140 is pivotally mounted on a rod 142 extending between side panels 74 and 76 of door 26. FIG. 4 illustrates cover 130 in an open position and cover 140 in a closed position. In the open position, the user has access through open front 60 to the storage compartment within door 24. In the closed position of cover 130 similar to that illustrated in FIG. 4 for door 140, the user is denied access to the open front 80 of door 26. In the closed position of covers 130 and 140, when doors 24 and 26 are closed, covers 130 and 140 maintain items stored within doors 24 and 26 in their proper position. Covers 130 and 140 include a plurality of apertures 130*c* and 140*c*, respectively, for mounting hooks to be subsequently described.

In the open position of covers 130 and 140, surfaces 130*a* and 140*a* provide an increased work surface which extends beyond the area of top panels 50 and 70 of doors 24 and 26, respectively. The surface area of covers 130 and 140 exceed the surface area of top panels 50 and 70 wherein the surface area of top panel 50 is defined as that area between side panels 54 and 56 and back panel 58 and open front 60. The surface area of top panel 70 being defined as the area between side panel 74 and 76 and back panel 78 and open front 80. Covers 130 and 140 thereby provide the user with expanded work surface which adjoins the work surface provided by top panel 32 of main storage compartment 22.

Figure 5:
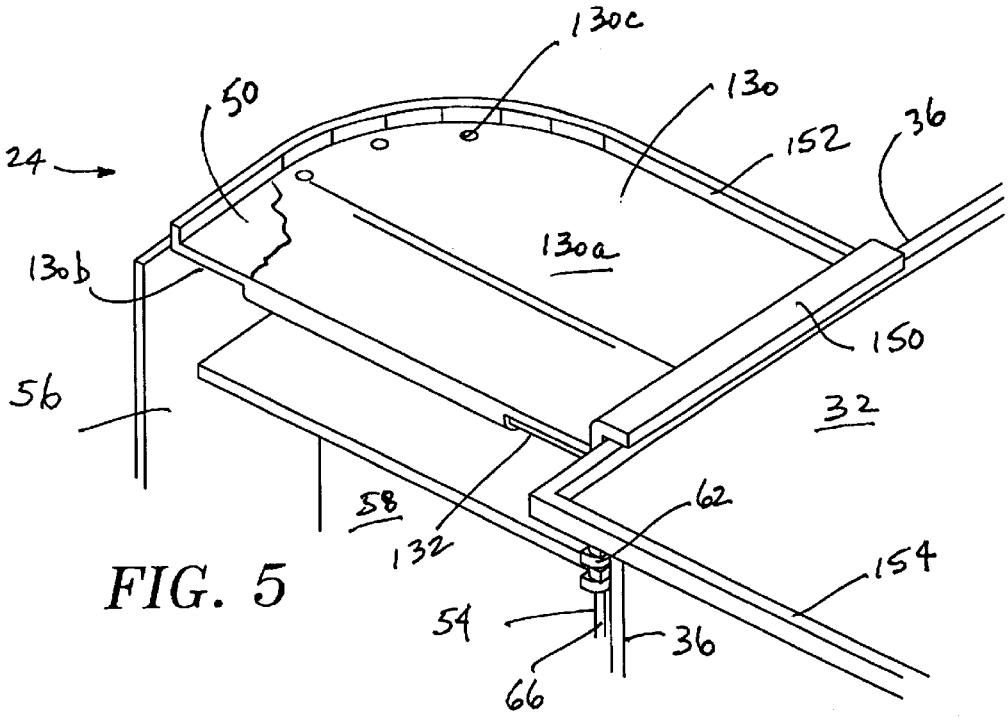
FIG. 5 is a perspective view of the present portable storage container illustrating the present door cover in the open position to provide a work surface.

Referring simultaneously to FIGS. 4 and 5, covers 130 and 140 are provided with an extension 150 which interconnects covers 130 and 140 to top panel 32 thereby providing greater support for covers 130 and 140 to increase the stability of the work, surfaces created by covers 130 and 140.

Surfaces 130*a* and 140*a* of covers 130 and 140, respectively, include a raised rim disposed around the edges thereof to prevent items from sliding off of covers 130 and 140 in the open position. Top panel 32 also includes a raised rim portion 154 to prevent items from sliding off of top panel 32 of main storage compartment 22.

Slidably disposed within main storage compartment 22 are drawers 160 and 162 and a tray 164. Drawers 160 and 162 and tray 164 are removable through open front 42 of main storage compartment 22.

Figure 6:
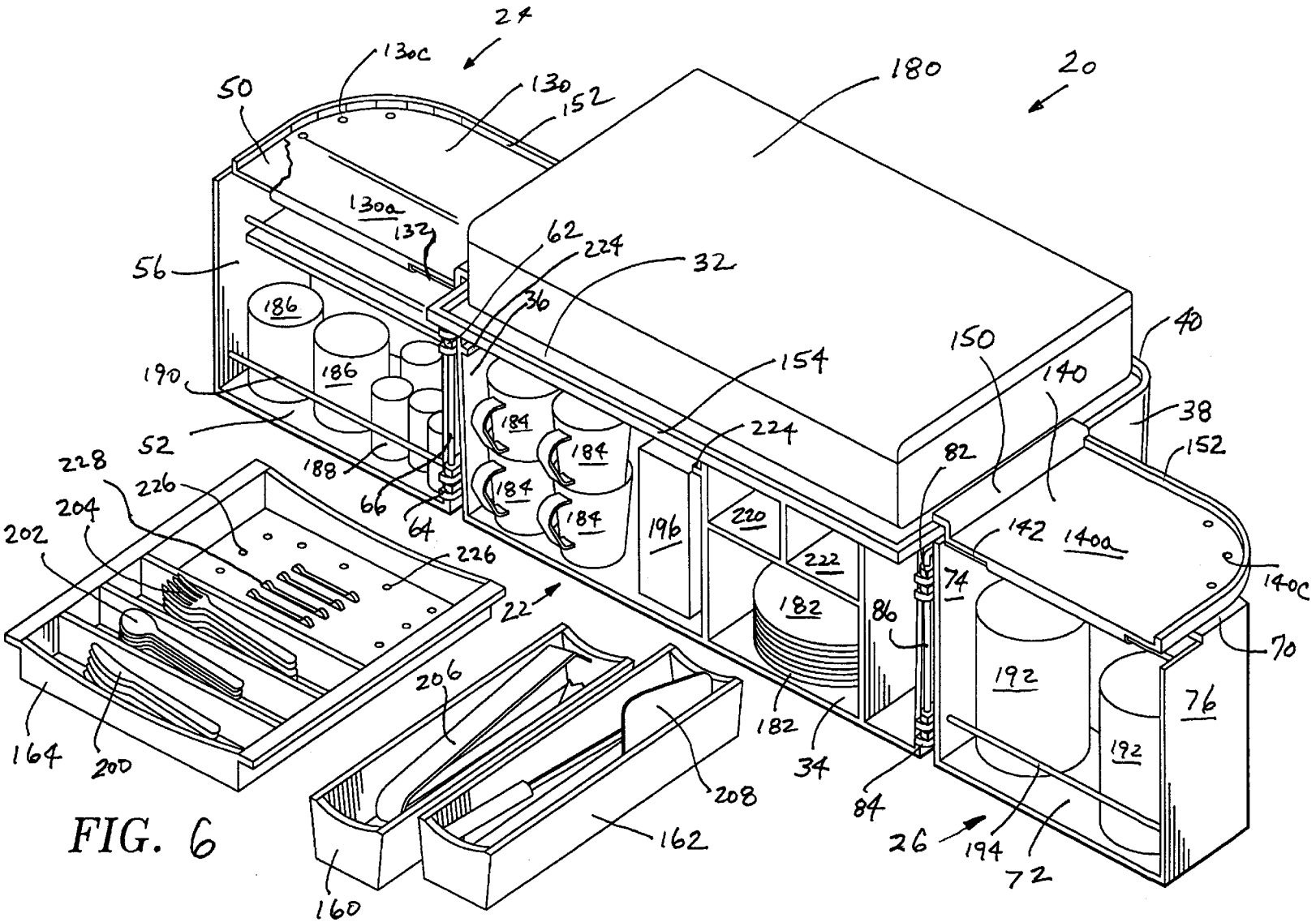
FIG. 6 is a perspective view of the present portable storage container illustrating the container functioning as a portable camp kitchen having stove, dishes, cups, utensils and food items stored therein with the present tray and drawers removed.

Referring now to FIG. 6, portable storage container 20 is shown being equipped with various items such that portable storage container 20 functions as a portable camp kitchen. Disposed on top panel 32 of main storage compartment 22 is a stove 180. Dishes 182 and cups 184 are stored within main storage compartment 22 and are accessible through open front 42. Various food items 186 and 188 are stored within door 24, and are accessible through open front 60. A rod 190 disposed between side panels 54 and 56 of door 24 maintains food items 186 and 188 contained within door 24. Food items or containers 192 are disposed within door 26. A rod 194 disposed between side panels 74 and 76 maintain food items 192 within door 26. An additional food item or container 196 is disposed within main storage compartment 22.

Tray 164 includes storage areas for eating utensils such as knives 200, spoons 202, and forks 204. Drawers 160 and 162 provide storage areas for cooking utensils such as, for example, tongs 206 and spatula 208. FIG. 6 illustrates drawers 160 and 162 removed from storage compartment 22. Drawers 160 and 162 are inserted within main storage compartment 22 and supported on shelves 220 and 222, respectively. Tray 164 is supported within main storage compartment 22 via a track 224.

Figure 7:
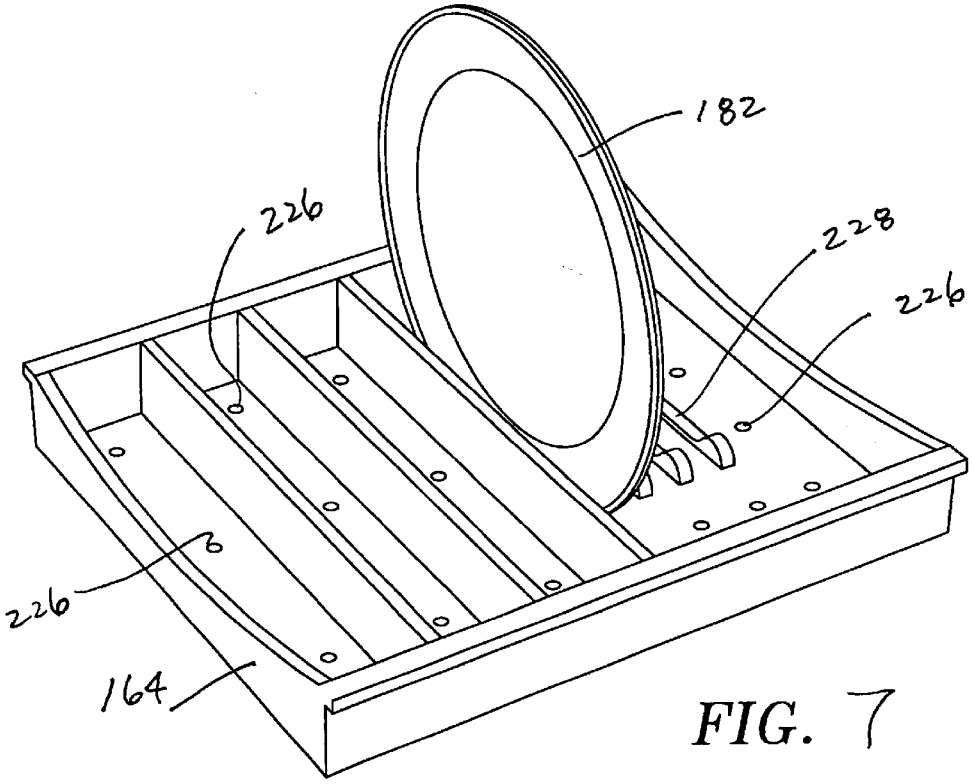
FIG. 7 illustrates a perspective view of the present tray for washing dishes.

FIG. 7 illustrates the use of tray 164 as a dish strainer for washing and drying dishes 182. Tray 164 includes apertures 226 for draining water from tray 164. Tray 164 also includes ribs 228 for supporting dishes 182. Tray 164 may be used in combination with lid 90 for washing dishes and eating utensils stored within the present portable storage container 20.

Figure 8:
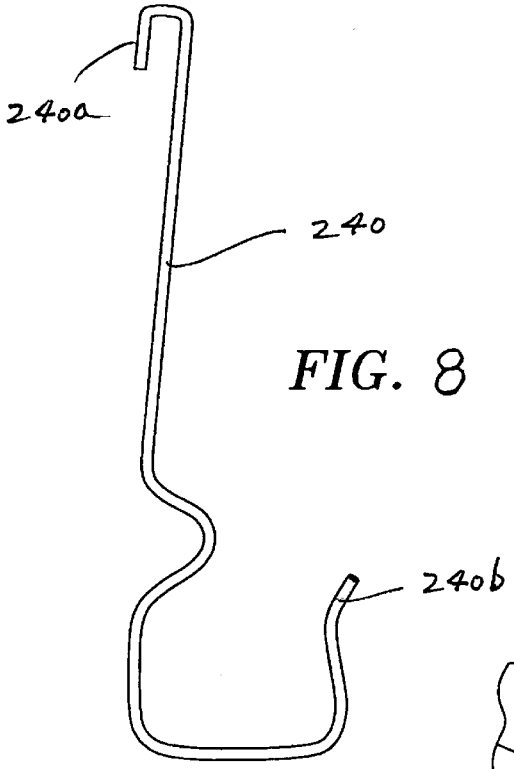
FIG. 8 is a side elevational view of the present hook for attachment to the present door cover.
Figure 9:
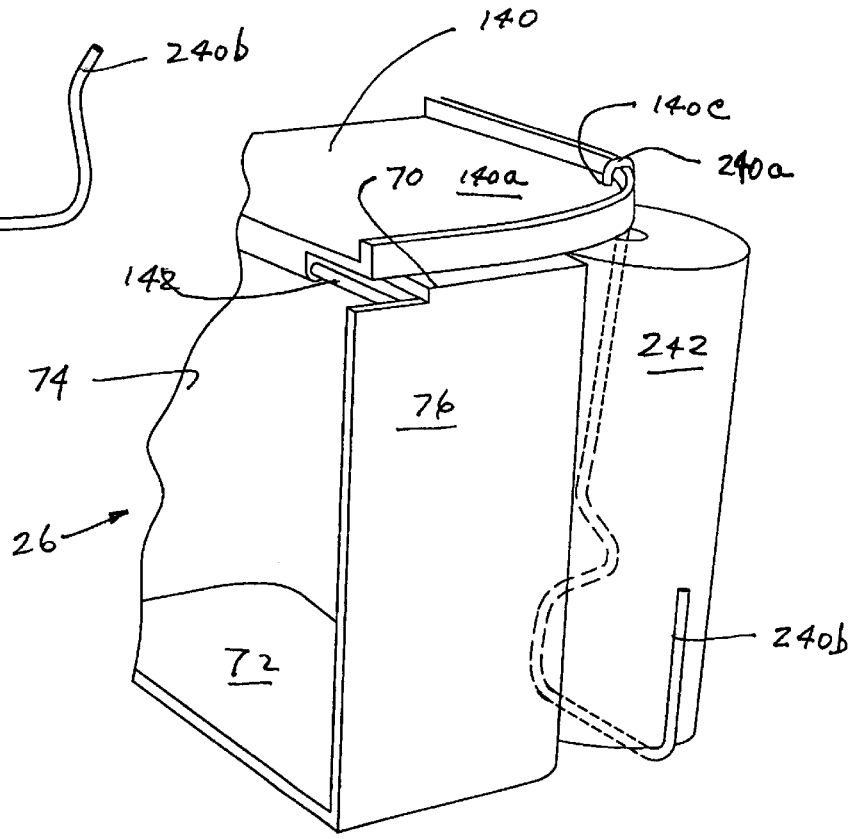
FIG. 9 is a perspective view illustrating the use of the present hook for supporting a roll of paper towels.

Referring now to FIGS. 8 and 9, a hook, generally identified by the numeral 240 having ends 240*a* and 240*b* is used with the present portable storage container for supporting a roll of paper towels 242 when portable storage container 20 is utilized as a portable camp kitchen. End 240*a* of hook 240 is inserted within one of the apertures 130*c* of cover 130 or apertures 140*c* of cover 140 as illustrated in FIG. 9 to provide a convenient location for storing paper towels 242. Hook 240 may also be utilized for hanging such items as dish towels and pot holders.

Portable storage container 20 may be fabricated from, for example, structural foam plastic for overall strength and durability. Top panel 32 is molded separately from main storage compartment 22, and is detachably secured to main storage compartment 22 using fasteners, such as for example, screws, so that the interior of main storage compartment 22 can be easily cleaned by removing panel 32. Lid 28 of storage container 20 sheds water as do doors 24 and 26, such that the interior of storage container 20 remains waterproof. Although portable storage container 20 has been shown for use as a camp kitchen, storage container 20 can also be used, for example, for the storage of sporting equipment, such as fishing supplies and for storing tools or medical supplies.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A portable storage container comprising:

a main storage compartment including a top panel, a base panel, spaced apart first and second side panels, a back panel and an open front;

said top panel of said main storage compartment including a raised rim disposed around edges thereof;

a first door having a top panel, a base panel, spaced apart first and second side panels, a back panel and an open front to form a first door storage compartment;

said first door being pivotably mounted to said first side panel of said main storage compartment and adapted to move between a closed position and an open position, such that in said open position said first door first side panel is disposed parallel to said first side panel of said main storage compartment to allow access to said open front of said main storage compartment, and in said closed position said first door partially closes said open front of said main storage compartment;

a second door having a top panel, a base panel, spaced apart first and second side panels, a back panel and an open front to form a second door storage compartment;

said second door being pivotably mounted to said second side panel of said main storage compartment and adapted to move between a closed position and an open position, such that in said open position said second door first side panel is disposed parallel to said second side panel of said main storage compartment to allow access to said open front of said main storage compartment, and in said closed position, said second door partially closes said open front of said main storage compartment; and said first and second doors in said closed position completely closing said open front of said main storage compartment.

2. The container of claim 1 and further including:

a detachable lid for said main storage area compartment to form a lid storage compartment disposed adjacent said top panel of said main storage compartment.

3. The container of claim 2 wherein said lid includes a handle.

4. The container of claim 2 wherein said lid includes a fastener for attaching said lid to said back panel of said main storage compartment and a fastener for attaching said lid to said first and second doors.

5. The container of claim 1 wherein said first and second side panels of said main storage compartment each include a handle.

6. The container of claim 1 wherein said back panels of said first and second doors are concave.

7. The container of claim 1 and further including:

a tray slidably disposed within said main storage area compartment and movable through said open front of said main storage area compartment.

8. The container of claim 1 and further including:

a drawer slidably disposed within said main storage area compartment and movable through said open front of said main storage area compartment.

9. A portable storage container comprising:

a main storage compartment including a top panel, a base panel, spaced apart first and second side panels, a back panel and an open front;

a first door having a top panel, a base panel, spaced apart first and second side panels, a back panel and an open front to form a first door storage compartment;

said first door being pivotably mounted to said first side panel of said main storage compartment and adapted to move between a closed position and an open position, such that in said open position said first door first side panel is disposed parallel to said first side panel of said main storage compartment to allow access to said open front of said main storage compartment, and in said closed position said first door partially closes said open front of said main storage compartment;

a second door having a top panel, a base panel, spaced apart first and second side panels, a back panel and an open front to form a second door storage compartment;

said second door being pivotably mounted to said second side panel of said main storage compartment and adapted to move between a closed position and an open position, such that in said open position said second door first side panel is disposed parallel to said second side panel of said main storage compartment to allow access to said open front of said main storage compartment, and in said closed position, said second door partially closes said open front of said main storage compartment;

said first and second doors in said closed position completely closing said open front of said main storage compartment;

said first door includes a cover pivotably mounted between said first and second side panels of said first door and adapted to move between a closed position for closing said open front of said first door and an open position parallel to said top panel of said first door; and said cover includes an extension for mating with said top panel of said main storage compartment in said cover open position.

10. The container of claim 9 wherein said top panel of said first door has a surface area defined between said first and second side panels and between said back panel and open front, and said cover has a surface area greater than said surface area of said first door top panel.

11. A portable storage container comprising:

a main storage compartment including a top panel, a base Panel, spaced apart first and second side panels, a back panel and an open front;

a first door having a top panel, a base panel, spaced apart first and second side panels, a back panel and an open front to form a first door storage compartment;

said first door being pivotably mounted to said first side panel of said main storage compartment and adapted to move between a closed position and an open position, such that in said open position said first door first side panel is disposed parallel to said first side panel of said main storage compartment to allow access to said open front of said main storage compartment, and in said closed position said first door Partially closes said open front of said main storage compartment;

a second door having a top panel, a base panel, spaced apart first and second side panels, a back panel and an open front to form a second door storage compartment;

said second door being pivotably mounted to said second side panel of said main storage compartment and adapted to move between a closed Position and an open position, such that in said open position said second door first side panel is disposed parallel to said second side panel of said main storage compartment to allow access to said open front of said main storage compartment, and in said closed position, said second door partially closes said open front of said main storage compartment;

said first and second doors in said closed position completely closing said open front of said main storage compartment;

said first door includes a cover pivotably mounted between said first and second side panels of said first door and adapted to move between a closed position for closing said open front of said first door and an open position parallel to said top Panel of said first door; and said cover including a raised rim disposed around edges thereof.

12. The container of claim 11 wherein said cover includes a plurality of apertures adapted to receive a hook.

13. A portable camp kitchen for housing a stove, dishes, cups, utensils and food items comprising:

a main storage compartment including a top panel, a base panel, spaced apart first and second side panels, a back panel and an open front, said top panel of said main storage compartment including a raised rim disposed around edges thereof;

a first door having a top panel, a base panel, spaced apart first and second side panels, a back panel and an open front to form a first door storage compartment;

said first door being pivotably mounted to said first side panel of said main storage compartment and adapted to move between a closed position and an open position, such that in said open position said first door first side panel is disposed parallel to said first side panel of said main storage compartment to allow access to said open front of said main storage compartment, and in said closed position, said first door partially closes said open front of said main storage compartment;

a second door having a top panel, a base panel, spaced apart first and second side panels, a back panel and an open front to form a second door storage compartment;

said second door being pivotably mounted to said second side panel of said main storage compartment and adapted to move between a closed position and an open position, such that in said open position said second door first side panel is disposed parallel to said second side panel of said main storage compartment to allow access to said open front of said main storage compartment, and in said closed position, said second door partially closes said open front of said main storage compartment; and said first and second doors in said closed position completely closing said open front of said main storage compartment.

14. The portable camp kitchen of claim 13 and further including:

a detachable lid for said main storage compartment to form a lid storage compartment disposed adjacent said top panel of said main storage compartment.

15. The portable camp kitchen of claim 14 wherein said lid includes a handle.

16. The portable camp kitchen of claim 14 wherein said lid includes a fastener for attaching said lid to said back panel of said main storage compartment and a fastener for attaching said lid to said first and second doors.

17. The portable camp kitchen of claim 14 wherein said lid storage compartment is adapted to store the stove.

18. The portable camp kitchen of claim 14 wherein said lid comprises a sink.

19. The portable camp kitchen of claim 13 wherein said first and second side panels of said main storage compartment each include a handle.

20. The portable camp kitchen of claim 13 wherein said back panels of said first and second doors are concave.

21. The portable camp kitchen of claim 13 and further including:

a tray slidably disposed within said main storage compartment and movable through said open front of said main storage compartment.

22. The portable camp kitchen of claim 21 wherein said tray is adapted to store the dishes.

23. The portable camp kitchen of claim 22 wherein said tray includes a plurality of apertures for draining the dishes.

24. The portable camp kitchen of claim 13 and further including:

a drawer slidably disposed within said main storage compartment and movable through said open front of said main storage compartment.

25. The portable camp kitchen of claim 24 wherein said drawer is adapted to store the utensils.

26. The portable camp kitchen of claim 13 wherein said first door includes a cover pivotably mounted between said first and second side panels of said first door and adapted to move between a closed position for closing said open front of said first door and an open position parallel to said top panel of said first door.

27. The portable camp kitchen of claim 26 wherein said top panel of said first door has a surface area defined between said first and second side panels and said back panel and open front, and said cover has a surface area greater than said surface area of said first door top panel.

28. The portable camp kitchen of claim 26 and further including a hook and wherein said cover includes an aperture adapted to receive said hook.

29. The portable camp kitchen of claim 28 wherein said hook is adapted to receive a roll of paper towels.

30. The portable camp kitchen of claim 13 wherein said main storage compartment is adapted to store items selected from the group consisting of dishes, cups, utensils and food.

31. The portable camp kitchen of claim 13 wherein said first and second door storage compartments are adapted to store the food items.

32. A portable camp kitchen for housing a stove, dishes, cups, utensils and food items comprising:

a main storage compartment including a top panel, a base panel, spaced apart first and second side panels, a back panel and an open front;

a first door having a top panel, a base panel, spaced apart first and second side panels, a back panel and an open front to form a first door storage compartment;

said first door being pivotably mounted to said first side panel of said main storage compartment and adapted to move between a closed position and an open position, such that in said open position said first door first side panel is disposed parallel to said first side panel of said main storage compartment to allow access to said open front of said main storage compartment, and in said closed position, said first door Partially closes said open front of said main storage compartment;

a second door having a top panel, a base panel, spaced apart first and second side panels, a back panel and an open front to form a second door storage compartment;

said second door being pivotably mounted to said second side panel of said main storage compartment and adapted to move between a closed position and an open position, such that in said open position said second door first side panel is disposed parallel to said second side panel of said main storage compartment to allow access to said open front of said main storage compartment, and in said closed position, said second door partially closes said open front of said main storage compartment;

said first and second doors in said closed position completely closing said open front of said main storage compartment;

said first door includes a cover pivotably mounted between said first and second side panels of said first door and adapted to move between a closed position for closing said open front of said first door and an open position parallel to said top panel of said first door; and said cover including an extension for mating with said top panel of said main storage compartment.

33. A portable camp kitchen for housing a stove, dishes, cups, utensils and food items comprising:

a main storage compartment including a top panel, a base panel, spaced apart first and second side panels, a back panel and an open front;

a first door having a top panel, a base panel, spaced apart first and second side panels, a back panel and an open front to form a first door storage compartment;

said first door being pivotably mounted to said first side panel of said main storage compartment and adapted to move between a closed position and an open position, such that in said open position said first door first side panel is disposed parallel to said first side panel of said main storage compartment to allow access to said open front of said main storage compartment, and in said closed position, said first door Partially closes said open front of said main storage compartment;

a second door having a top panel, a base panel, spaced apart first and second side panels, a back panel and an open front to form a second door storage compartment;

said second door being pivotably mounted to said second side panel of said main storage compartment and adapted to move between a closed position and an open position, such that in said open position said second door first side panel is disposed parallel to said second side panel of said main storage compartment to allow access to said open front of said main storage compartment, and in said closed position, said second door partially closes said open front of said main storage compartment;

said first and second doors in said closed position completely closing said open front of said main storage compartment;

said first door includes a cover pivotably mounted between said first and second side panels of said first door and adapted to move between a closed position for closing said open front of said first door and an open position parallel to said top panel of said first door; and said cover including a raised rim disposed around edges thereof.

* * * * *

UNITED STATES PATENT AND TRADEMARK OFFICE

CERTIFICATE OF CORRECTION

PATENT NO. : 6,619,768 B1
DATED : September 16, 2003
INVENTOR(S) : Melaney Northrop et al.

It is certified that error appears in the above-identified patent and that said Letters Patent is hereby corrected as shown below:

Column 5,
Lines 46, 61, 63, 65 and 67, delete the word "area" after "storage"

Column 6,
Line 49, replace "Panel" with -- panel --.
Line 61, replace "Partially" with -- partially --.

Column 7,
Line 1, replace "Position" with -- position --.
Line 16, replace "Panel" with -- panel --.

Column 8,
Line 63, replace "Partially" with -- partially --.

Column 10,
Line 5, replace "Partially" with -- partially --.

Signed and Sealed this

Fourteenth Day of October, 2003

JAMES E. ROGAN
*Director of the United States Patent and Trademark Office*